US009972915B2

(12) United States Patent
Milroy et al.

(10) Patent No.: US 9,972,915 B2
(45) Date of Patent: May 15, 2018

(54) OPTIMIZED TRUE-TIME DELAY BEAM-STABILIZATION TECHNIQUES FOR INSTANTANEOUS BANDWITH ENHANCEMENT

(71) Applicant: ThinKom Solutions, Inc., Torrance, CA (US)

(72) Inventors: William Milroy, Torrance, CA (US); Alan C. Lemons, San Pedro, CA (US)

( * ) Notice: Subject to any disclaimer, the term of this patent is extended or adjusted under 35 U.S.C. 154(b) by 627 days.

(21) Appl. No.: 14/568,372

(22) Filed: Dec. 12, 2014

(65) Prior Publication Data

US 2018/0069321 A1 Mar. 8, 2018

(51) Int. Cl.

| | |
|---|---|
| ***H01Q 3/00*** | (2006.01) |
| ***H01Q 21/00*** | (2006.01) |
| ***H01Q 15/24*** | (2006.01) |
| ***H01Q 21/22*** | (2006.01) |
| ***H01Q 3/26*** | (2006.01) |
| *H01Q 13/10* | (2006.01) |

(52) U.S. Cl.

CPC ..... *H01Q 21/0025* (2013.01); *H01Q 3/2694* (2013.01); *H01Q 15/24* (2013.01); *H01Q 21/22* (2013.01); *H01Q 3/2682* (2013.01); *H01Q 13/10* (2013.01)

(58) Field of Classification Search

CPC ..... H01Q 9/00; H01Q 13/10; H01Q 3/04; H01Q 3/2682; H01Q 3/2676; H01Q 3/00; H01Q 3/023; H01Q 3/2694; H01Q 21/0025; H01Q 21/22; H01Q 15/24; H01P 3/00; H01P 3/023

USPC ..... 342/372

See application file for complete search history.

(56) References Cited

U.S. PATENT DOCUMENTS 6,208,308 B1 * 3/2001 Lemons ..... H01O 13/085 343/767
6,473,057 B2 * 10/2002 Monzon ..... H01O 3/14 343/754
7,432,871 B2 * 10/2008 Milroy ..... H01O 21/0031 343/771
9,653,801 B2 * 5/2017 Milroy ..... H01O 3/16

(Continued)

OTHER PUBLICATIONS

Mailloux, Robert J.; "A Low-Sidelobe Partially Overlapped Constrained Feed Network for Time-Delayed Subarrays"; IEEE Transactions on Antennas and Propagation; vol. 49, No. 2; Feb. 2001.

(Continued)

*Primary Examiner* — Chuong P Nguyen

(74) *Attorney, Agent, or Firm* — Renner Otto Boisselle and Sklar

(57) ABSTRACT

An antenna includes an aperture defining a feed area of the antenna, the aperture divided into a plurality of discrete subarrays, and a feed network having an input port, a plurality of output ports, and a plurality of conductors, each conductor connected between the input port and a respective output port the plurality of output ports, and each output port of the plurality of output ports connected to a respective subarray of the plurality of subarrays. A line length of one conductor of the plurality of conductors is different from a line length of another conductor of the plurality of conductors to introduce different time delays between the input port and the respective output ports.

24 Claims, 14 Drawing Sheets

*VICTS Antenna with subarrayed feeding*

(56) References Cited

U.S. PATENT DOCUMENTS

| | | | | |
|---|---|---|---|---|
| 2003/0016097 | A1* | 1/2003 | McKinzie, III | H01Q 3/2682 333/161 |
| 2004/0233117 | A1* | 11/2004 | Milroy | H01Q 3/04 343/770 |
| 2012/0177376 | A1 | 7/2012 | Chang et al. | |
| 2015/0061795 | A1* | 3/2015 | Milroy | H01P 3/00 333/24 R |
| 2015/0229026 | A1* | 8/2015 | Lindmark | H01O 21/064 343/770 |

OTHER PUBLICATIONS

Hashemi, H et al.; "Integrated True-Time-Delay-Based Ultra-Wideband Array Processing"; IEEE Communications Magazine; vol. 46, No. 9; Sep. 2008.

* cited by examiner

Conventional VICTS Antenna Architecture

*VICTS Antenna with subarrayed feeding*

Typical Subarray-Fed VICTS Aperture

Typical Subarray-Fed VICTS Aperture

*Stabilized Beam Position vs. Scan Angle (Optimized for 32 Degree Scan Angle)*

Integrated VICTS Aperture with Subarray Feed Region and Corporate Feed

VICTS Array Employing Beam-Stabilization Invention (X dimension only)
60
14
38
34a
36
37
34n
Integrated VICTS Aperture with Subarray Feed Region and Corporate Feed
Indicates corporate feed input port y
x

OPTIMIZED TRUE-TIME DELAY BEAM-STABILIZATION TECHNIQUES FOR INSTANTANEOUS BANDWITH ENHANCEMENT

TECHNICAL FIELD

The present disclosure relates generally to antennas and, more particularly, to an apparatus and method for providing a feed system to an antenna that enhances instantaneous bandwidth over a near hemispherical scan volume.

BACKGROUND ART

Antennas are generally characterized by their bandwidth properties into two categories—instantaneous bandwidth (IBW) and tunable bandwidth. Instantaneous bandwidth refers to the band of frequencies over which an antenna can maintain its (radiated) main beam in a fixed position in space. Tunable bandwidth refers to the band of frequencies over which an antenna exhibits well-matched input impedance at its input port.

In general, an antenna's instantaneous bandwidth is not equal to its tunable bandwidth. Many of today's SATCOM and Terrestrial point-to-point (PTP) communication systems require operation over larger instantaneous bandwidths (e.g., advanced extremely high frequency (AEHF), 1 GHz on receive and 2 GHz on transmit). Similarly, many radar systems (Synthetic Aperture Radar for example) require large instantaneous bandwidths for enhanced high-resolution imaging.

To achieve adequate signal levels over wide IBWs, the terminal antenna must maintain an uninterrupted connection over the entire bandwidth. This requires the terminal antenna main beam to remain trained on the axis of the satellite (or axis of the target) with minimal movement over frequency. For mobile terrestrial or aeronautical applications an additional requirement is that the antenna main beam remain trained on the satellite over a near-hemispherical scan volume (i.e., 10 to 90 degrees elevation, 0 to 360 degrees azimuth). In addition, to minimize aerodynamic drag, the antenna should be low profile.

Achieving both the aforementioned large IBW and near-hemispherical scan coverage in a low profile package can be challenging for traditional phase arrays due to the various hardware modules that are required (e.g., phase shifters and Variable True Time Delay (VTTD) components). Additional drawbacks to traditional phased arrays may include reduced ohmic efficiency, increased weight, and unacceptable height profile. These deficiencies may make a fully functioning traditional phased-array antenna cost prohibitive.

Some traditional antenna systems can achieve the desired IBW performance but do so usually at the cost of increased size, increased weight, and/or increased profile. Gimbaled reflector and slotted array antenna systems, for example, can be made to track a satellite over frequency and scan but usually require a high profile installation not compatible with most aeronautical and some terrestrial applications, particularly when low drag, low observable installations are required.

Phased arrays seem ideally suited for low profile installations. Along with being able to achieve a desired scan volume the phased array must be capable of maintaining a fixed or quasi-fixed beam position over the desired transmit or receive IBW at arbitrary scan. This may pose a problem for traditional phased arrays that are comprised of multiple radiating elements (or modules) fed with a passive corporate feed network having equal line lengths (true-time-delay) to all elements. In this case, beamwalk will be minimized only at broadside (i.e., a scan angle of 0 degrees). If instead the equal line lengths are adjusted to favor a scan angle other than broadside (e.g., a beam position of 45° at an azimuth of 0°), then the beam-walk will be severely degraded when the main beam is commanded to the diametrically symmetric beam position (i.e., a beam position of 45° at an azimuth of 180°), which risks potential loss of connection with a satellite and thus limits the usable scan volume of the array. This problem may be overcome somewhat by adding variable true time delay (VTTD) networks between the corporate feed and each radiating element of the array. Each VTTD allows the time-delay to be adjusted for scan angle (via a switchable N-bit "line-stretching" device). However, the addition of VTTDs (and discrete VTTD control devices) to the array increases the complexity, power consumption, weight and height profile of the overall system, all of which may be cost prohibitive.

The above deficiencies may be somewhat mitigated by modularizing the array into a set of discrete subarrays. Within each subarray a separate feed network distributes power to each individual element. The phase of each element within a subarray can be independently adjusted to scan the subarray (element factor) to a desired scan angle. Though a VTTD is still required between each subarray and the corporate feed, the total number of VTTDs will be less when using subarrays. Since the aperture area of each subarray is a fraction of the total array area, its 3 dB beamwidth will be many times that of the full array. While the main beam of each subarray will move with frequency, the total pattern as determined by the product of the subarray antenna pattern (element factor) and the corporate feed plus VTTDs (array factor) will move negligibly. This arrangement serves to provide good IBW while reducing the required number of VTTDs. However, the desired number of subarrays and VTTDs must be traded with the quantization side lobe levels (which may be excessive) and attendant directivity loss that will now be part of the full antenna pattern.

SUMMARY OF INVENTION

An apparatus and method in accordance with the present disclosure provide a unique feed system that offers superior instantaneous bandwidth (IBW) over near-hemispherical scan volume for an antenna, such as a Variable Inclination Continuous Transverse Stub (VICTS) antenna. More particularly, an antenna aperture is divided into a plurality of subarrays, and a feed network is provided to communicate a signal from an antenna feed to each subarray. The feed network is configured to introduce different time delays between the input port and the respective output ports. The feed network also can be configured to supply a prescribed inter-subarray phasing over a scan volume that maintains phase alignment of a main beam at a prescribed center frequency, to cause the plurality of subarrays to point in a direction that creates constructive interference, and/or to cause the plurality of subarrays to coherently combine a signal in a prescribed direction.

The apparatus and method have all the advantages of VICTS antennas including high efficiency, low profile, and well-behaved impedance match versus frequency and scan. The antenna offers an extremely low cost alternative to available phased-array antennas that require complex variable-true-time-delay architectures in order to meet the increasingly wider IBW bandwidths associated with next-generation commercial and military communication and radar systems.

According to one aspect of the invention, an antenna includes: an aperture defining a feed area of the antenna, the aperture divided into a plurality of discrete subarrays; and a feed network having an input port, a plurality of output ports, and a plurality of conductors, each conductor connected between the input port and a respective output port the plurality of output ports, and each output port of the plurality of output ports connected to a respective subarray of the plurality of subarrays, wherein a line length of one conductor of the plurality of conductors is different from a line length of another conductor of the plurality of conductors to introduce different time delays between the input port and the respective output ports.

In one embodiment, the line length between the input port and the respective output ports is configured to supply a prescribed inter-subarray phasing over a scan volume that maintains phase alignment of a main beam at a prescribed center frequency.

In one embodiment, the line length between the input port and the respective output ports is configured to cause the plurality of subarrays to point in a direction that creates constructive interference.

In one embodiment, the line length between the input port and the respective output ports is configured to cause the plurality of subarrays to coherently combine a signal in a prescribed direction.

In one embodiment, a difference in line length between the input port and the respective output ports is a multiple of 2 pi.

In one embodiment, the antenna includes alternating feed geometries that provide a phase shift of pi, wherein a difference in line length between the input port and the respective output ports is a multiple of pi.

In one embodiment, individual line lengths between the input port and a respective output port progressively increase in length.

In one embodiment, the plurality of subarrays and the feed network are passive devices.

In one embodiment, the plurality of subarrays and the feed network form a passive two-dimensional phased array.

In one embodiment, the plurality of subarrays and the feed network form a passive one-dimensional phased array.

In one embodiment, the plurality of subarrays are arranged in a first plane of the antenna, and feed boundaries of the plurality of subarrays extend in a second plane of the antenna different from the first plane.

In one embodiment, the feed network feeds the subarrays in the first plane, and a traveling wave feeds the subarray feed boundaries.

In one embodiment, a spacing between each element of the traveling wave is configured to produce a composite phase of the coupled wave that reduces a natural beam motion of the antenna aperture versus frequency.

In one embodiment, the first plane comprises one of the x-plane or the y-plane, and the second plane comprises the other of the x-plane or the y-plane.

In one embodiment, the first plane comprises the x-plane, and differences in line length between the input port and the respective output ports are phased in a plane parallel to the x-plane.

In one embodiment, the first plane comprises the y-plane, and differences in line length between the input port and the respective output ports are phased in a plane parallel to the y-plane.

In one embodiment, the antenna does not include phase shifters or variable time delay devices.

In one embodiment, the feed network is configured to provide true-time delay feeding at a prescribed intermediate scan angle.

In one embodiment, the antenna includes an antenna input for receiving a radio frequency (RF) signal, the antenna input connected to the input port.

In one embodiment, the antenna comprises a variable inclination continuous transverse stub (VICTS) antenna.

In one embodiment, as an aperture of the antenna is rotated, linearly increasing phases factors are created between subarrays.

In one embodiment, the antenna includes a first conductive plate structure including a first set of continuous transverse stub radiators arranged on a first surface; and a second conductive plate structure disposed in a spaced relationship relative to the first conductive plate structure, the second conductive plate structure having a surface parallel to the first surface; and a relative rotation apparatus operative to impart relative rotational movement between the first conductive plate structure and the second conductive plate structure.

In one embodiment, the antenna includes a polarizer.

To the accomplishment of the foregoing and related ends, the invention, then, comprises the features hereinafter fully described and particularly pointed out in the claims. The following description and the annexed drawings set forth in detail certain illustrative embodiments of the invention. These embodiments are indicative, however, of but a few of the various ways in which the principles of the invention may be employed. Other objects, advantages and novel features of the invention will become apparent from the following detailed description of the invention when considered in conjunction with the drawings.

BRIEF DESCRIPTION OF DRAWINGS

In the annexed drawings, like references indicate like parts or features.

DETAILED DESCRIPTION OF INVENTION

Figure 1:
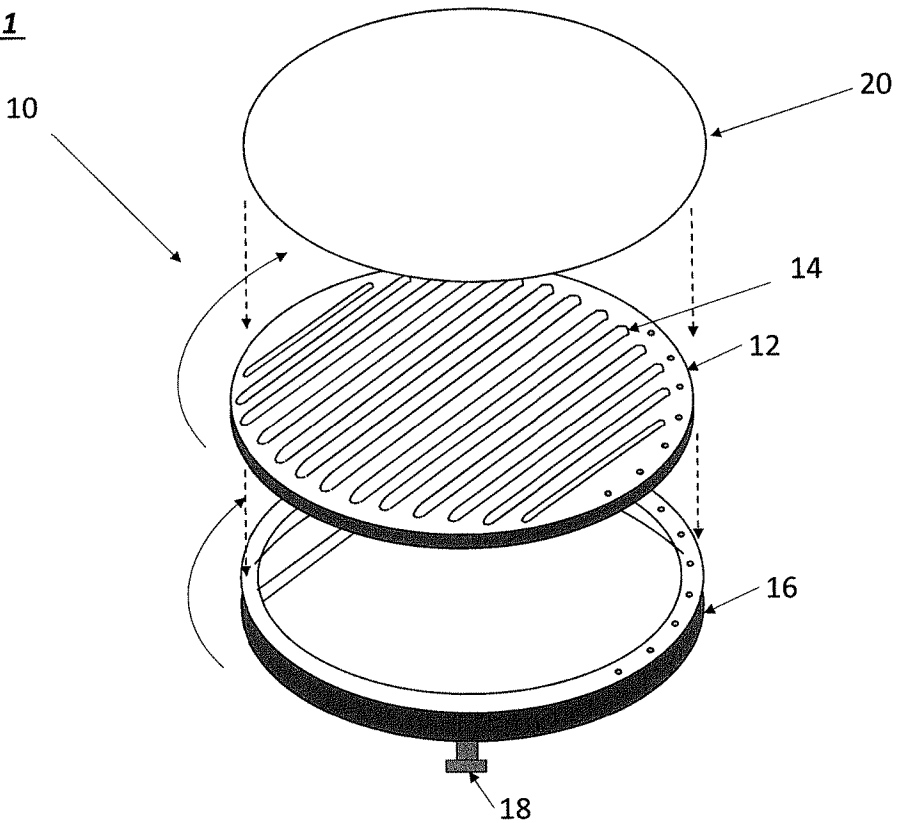
FIG. 1 is an exploded view of a generic VICTS antenna.

With reference to FIG. 1, a passive antenna in the form of a generic VICTS antenna 10 is shown. The VICTS antenna 10 includes a first or upper conducting plate 12 (aperture) having long continuous slots 14, and a one-dimensional lattice of continuous radiating stubs (not shown) formed on a surface of the upper plate 12. The continuous radiating stubs may be formed as a collection of identical, parallel, uniformly-spaced radiating stubs over the entire surface area of the upper plate 12.

The VICTS antenna 10 further includes second or lower conducting plate 16 (feed) having an antenna feed 18 that emanates into a parallel-plate region formed and bounded between the upper plate 12 and the lower plate 16. A polarizer 20 may be added on top of the upper conducting plate 12 for polarization diversity.

The stub-aperture configuration of the VICTS antenna serves to couple energy from the parallel-plate region (formed between the upper-most conductive surface and the lower-most conductive surface), thus forming a radiated main beam in the far-field of the antenna 10. Mechanical rotation of the upper plate 12 relative to the lower plate 16 serves to vary the inclination of incident parallel-plate modes, launched at the antenna feed 18, relative to the continuous transverse stubs in the upper plate 12, and in doing so constructively excites a radiated planar phase-front whose angle relative to the mechanical normal of the array is a simple continuous function of the relative angle of (differential) mechanical rotation between the two plates 12 and 16. Common rotation of the two plates 12 and 16 in unison moves the phase-front in the orthogonal azimuth direction. Additional details concerning a VICTS antenna can be found in U.S. Pat. No. 6,919,854 issued on Jul. 19, 2005 and U.S. patent application Ser. No. 14/104,466 filed on Dec. 12, 2013, each hereby incorporated by reference in its entirety.

Unique to VICTS architecture is its ability to scan a main beam over a near-hemispherical scan volume. Scanning in elevation is achieved via differential rotation of the plates 12 and 16 while scanning in azimuth is achieved via the common rotation of the plates 12 and 16. Thus a two-dimensional scanning phased array is created without phase shifters. Other advantages of VICTS antennas include high ohmic efficiency, low profile, low part count (as little as 3 parts) and low implementation cost. A unique property of VICTS antennas is that their beamwalk per percent bandwidth, when normalized to broadside beamwidth, is constant. This contrasts with that of traditional phased arrays whose beamwalk increases faster at progressively larger scan angles. Achievable IBW of an un-subarrayed VICTS is proportional to wavelength and inversely proportional to aperture diameter.

An antenna in accordance with the present disclosure, such as a VICTS antenna, combines a subarray-fed VICTS aperture and a novel feed network to achieve special frequency sensitivities and properties. The antenna can include an aperture defining a feed area of the antenna, where the aperture is divided into a plurality of discrete subarrays. A feed network of the antenna includes an input port, a plurality of output ports and a plurality of conductors, where each conductor is connected between the input port and a respective output port of the plurality of output ports, and each output port of the plurality of output ports is connected to a respective subarray of the plurality of subarrays. The feed network is configured to introduce different time delays between the input port and the output ports. For example, to achieve different time delays in the feed system, a conductor line length between the input port and one of the plurality of output ports can be different from a conductor line length between the input port and another one of the plurality of output ports.

Figure 2:
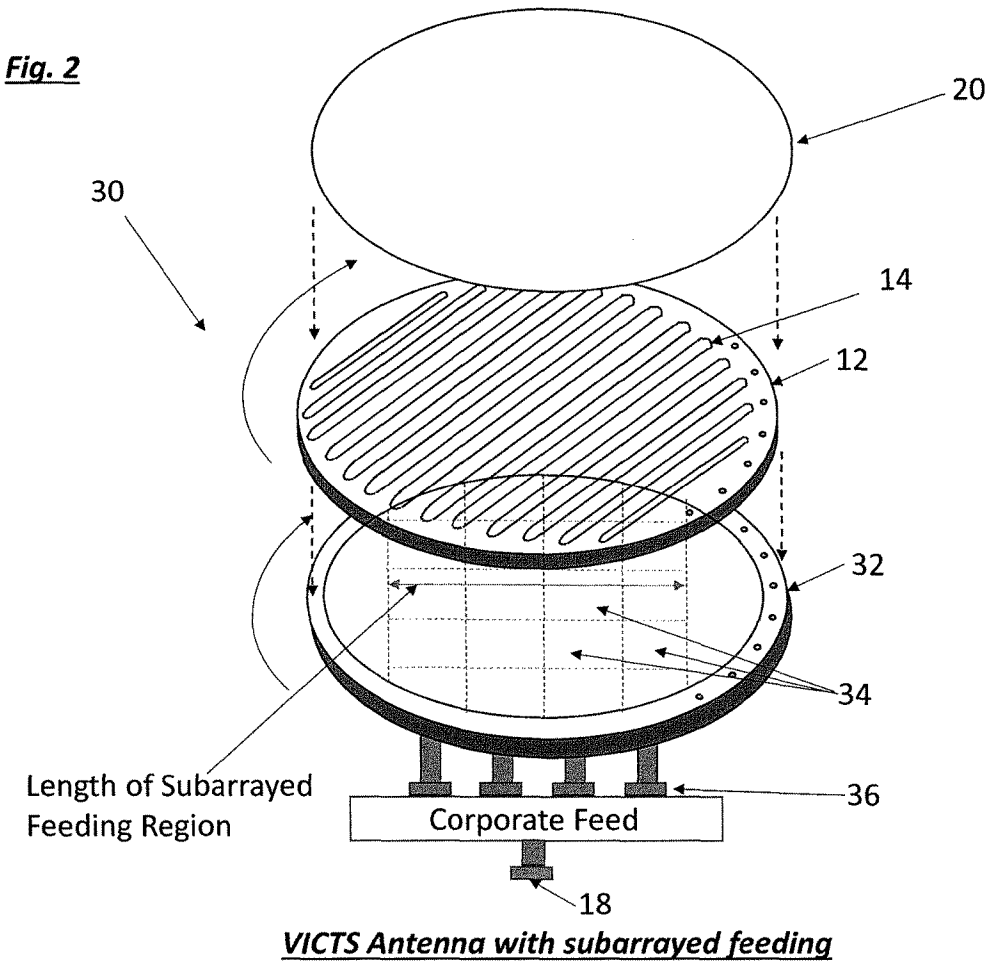
FIG. 2 is an exploded view of a VICTS antenna with subarrayed feeding in accordance with the present disclosure.

Referring to FIG. 2, an exemplary VICTS antenna 30 in accordance with the present disclosure is illustrated that provides improved IBW. The VICTS antenna 30 includes an upper plate 12 with slots 14 and continuous radiating stubs (not shown), antenna feed 18, and polarizer 20 as described above with respect to FIG. 1. The VICTS antenna 30 also includes a modified lower plate 32. More particularly, the lower plate 32 includes a subarrayed-fed VICTS array 34 combined with a corporate feed 36, which is connected to the antenna feed 18, the corporate feed 36 having different path lengths that introduce different time delays for each subarray. Such configuration enables near-hemispherical scan coverage while achieving superior IBW. Moreover, the approach presented in FIG. 2 is completely passive and does not require phase shifters nor VTTDs to achieve good IBW.

The VICTS antenna 30 in accordance with the present disclosure is a variation of the traditional VICTS architecture that achieves much higher levels of IBW by virtue of subarraying. More particularly, and with additional reference to FIGS. 4A and 4B, the feed area is divided into a lattice of N subarrays 34*a*-34*n*, which may be arbitrary in shape but are usually rectangular. Each subarray 34*a*-34*n* operates independently as a radiating antenna with all the properties and advantages associated with VICTS antennas described previously. The passive corporate feed 36 with one input port 37 (which is connected to the antenna feed 18) and N output ports 36*a*-36*n* is connected to the N input ports of the subarrays 34*a*-34*n*.

A problem addressed by the antenna in accordance with the present disclosure is beamwalk (an undesired change in antenna beam pointing position as a function of frequency). Conventionally, beamwalk increases with scan angle, and is typically addressed by utilizing variable true time delay (VTTD) networks between the corporate feed and each radiating element of the array. However, and as noted above, such VTTDs increase both cost and complexity and thus are undesirable. In accordance with the present disclosure, in one embodiment the corporate feed 36 and subarrays 34 are designed to provide a low profile, low cost two-dimensional Phased Array possessing IBW superior to that of conventional phased arrays without the need for phase shifters or VTTDs. In this regard, the antenna is divided into subarray sections, which preferably are square or rectangular in shape, each subarray section coupled to a corporate feed output port. The line length from the corporate feed input port to each corporate feed output port is then adjusted to produce a time delay that provides for optimal beam stabilization with frequency. In configuring the line length, the physical size of the antenna, the IBW and scan range may be taken into account in determining the optimal delay (relative transmission-line path length for each subarray). The IBW of such subarrayed VICTS 30 is larger than that of a non-subarrayed VICTS 10 by a factor approximately equal to the number of subarrays 34*a*-34*n* along either length of the subarrayed feeding region 33 (i.e., the region defined by the subarrays 34*a*-34*n*).

Figure 3:
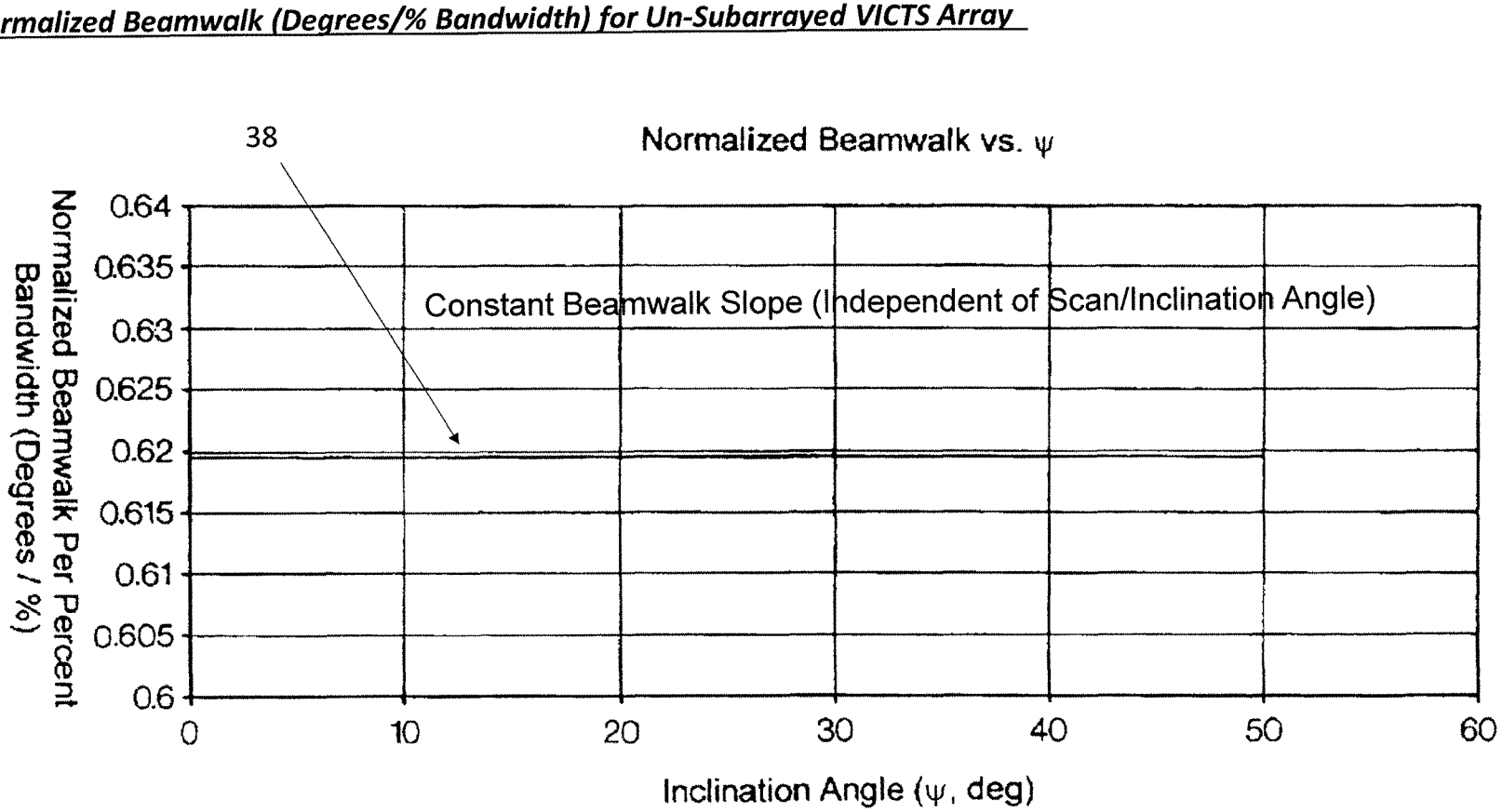
FIG. 3 is a graph showing normalized beamwalk for a non-subarrayed VICTS antenna.

Advantages of the VICTS antenna 30 in accordance with the present disclosure over conventional approaches include reduced profile, size, weight, power consumption and superior IBW. For example, and with reference to FIG. 3, a conventional non-subarrayed VICTS 10 possesses constant normalized beamwalk 38 over scan versus frequency. This limits the IBW of such non-subarrayed version of VICTS antenna to frequency ranges such that the beamwalk of the antenna 10 is small compared to its intrinsic beamwidth (typically +/−¼ beamwidth.) By subdividing and combining a number of subarrays 34*a*-34*n* to form a larger array with a corporate feed 36 in accordance with the present disclosure, beamwalk is reduced to virtually zero degrees at a pre-selected intermediate scan angle and increases only modestly at all other scan angles, thereby significantly increasing the IBW of the composite antenna 30. Further, the roll-off loss as the main beam moves off-axis at larger scan angles is offset by the associated increase in beamwidth, while at smaller scan angles the beam walk loss is offset by the associated increase in directivity. This unique property along with the IBW performance described above provides a novel antenna.

Figure 4A:
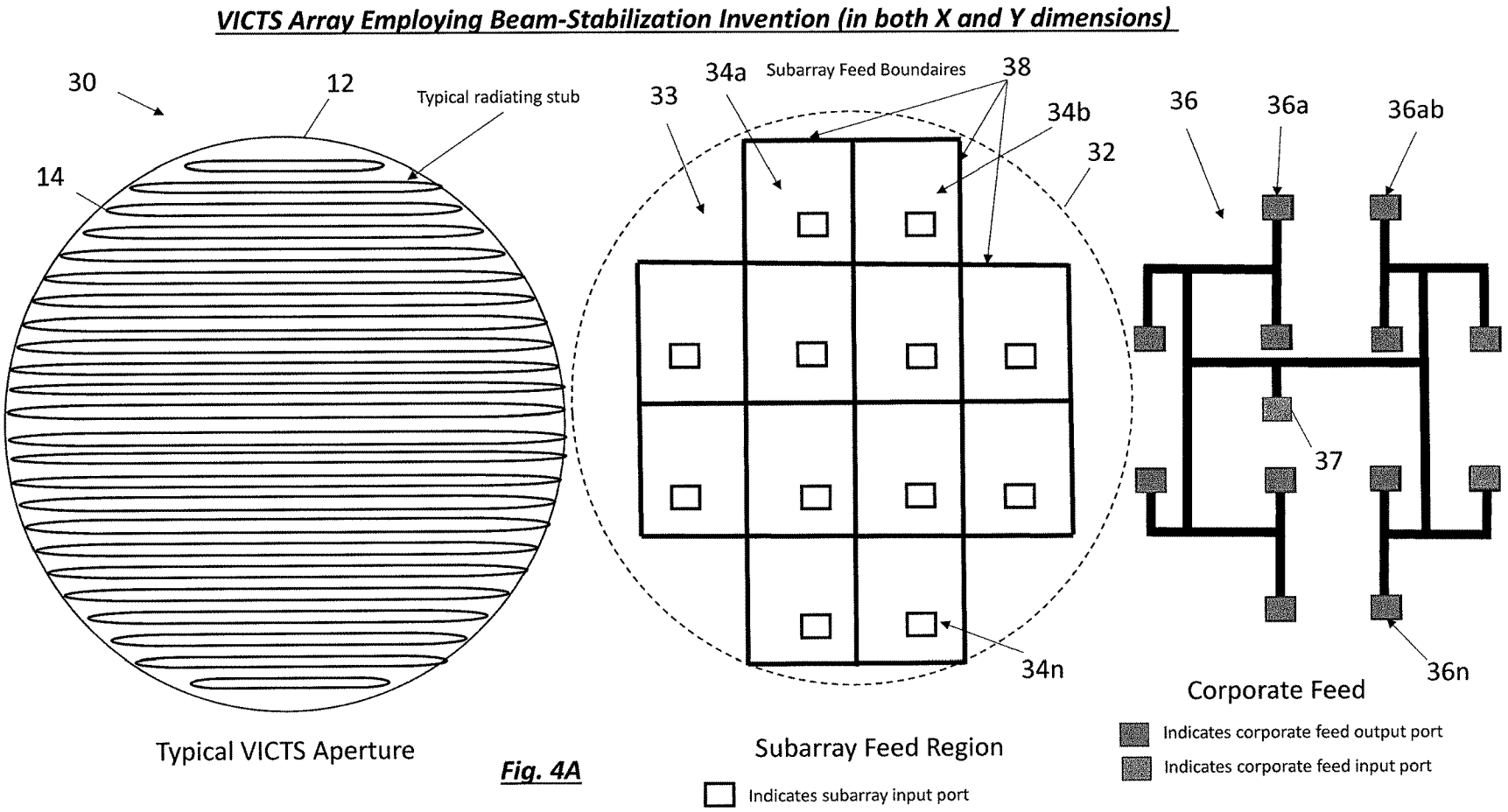
FIG. 4A is a schematic diagram showing a typical VICTS aperture, subarray feed region and corporate feed for a VICTS antenna that employs beam-stabilization in both the X and Y dimensions in accordance with the present disclosure.
Figure 4B:
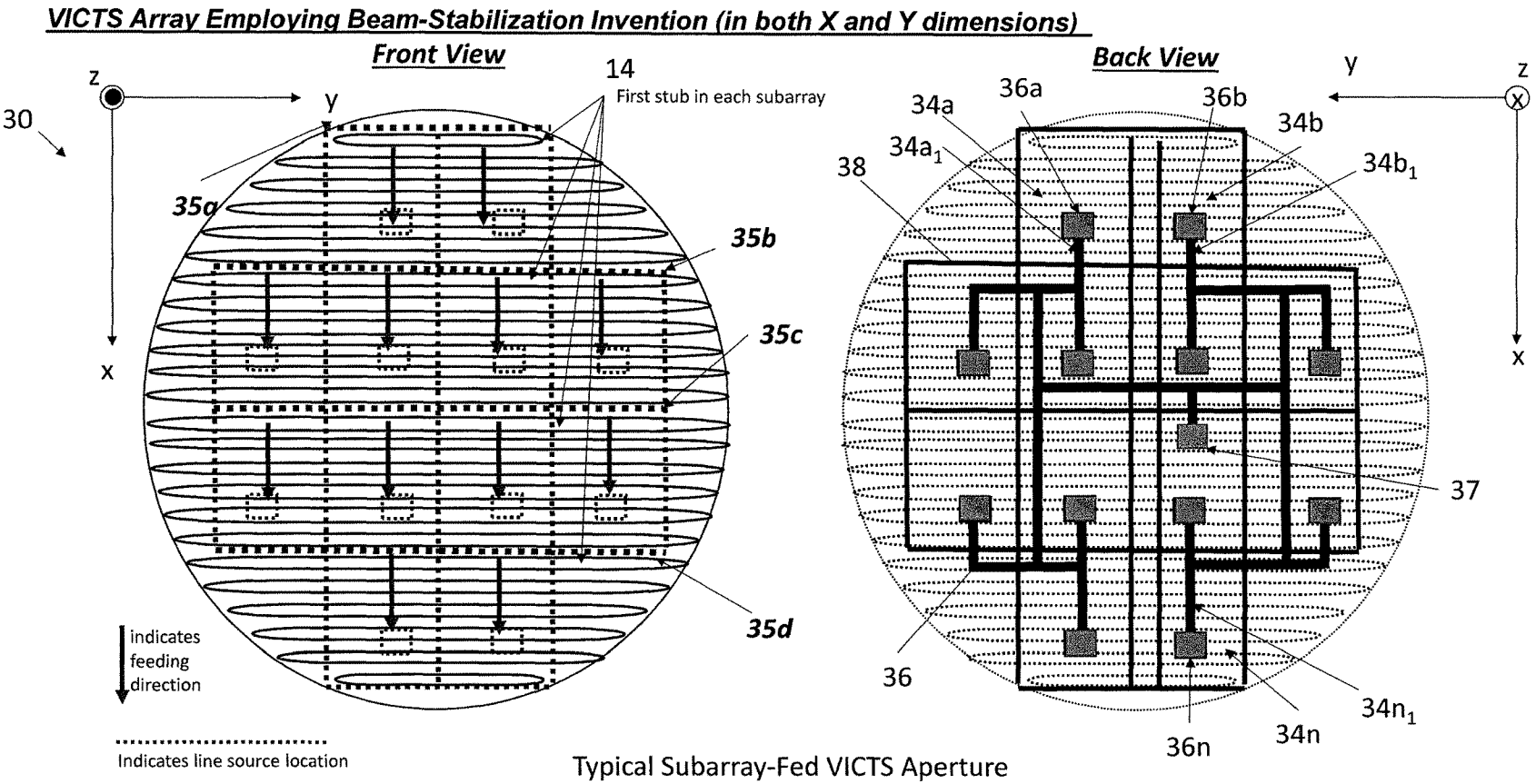
FIG. 4B is a schematic diagram showing a typical physical and angular relationship between the aperture and subarray feeds (front and back views) for the VICTS antenna of FIG. 4A, in the unscanned condition.

With continued reference to FIGS. 4A and 4B, the VICTs antenna 30 includes a VICTS aperture (e.g., upper plate 12), subarrayed feed region 33 having a plurality of subarrays 34*a*-34*n*, and corporate feed network 36 having an input port 37 (connected to antenna feed 18) and a plurality of output ports 36*a*-36*n*. In another embodiment, more or less subarrays 34, apertures 14, stubs (not shown) and/or corporate feed networks 36 may be present.

FIG. 4B shows front and back views of the assembled VICTS antenna 30. Each subarray 34*a*-34*n* includes its own feed system 34$a_1$-34$n_1$ that distributes RF power to a respective line source 35*a*-35*d* (the horizontal feed portion for each group of subarrays in FIG. 4B) along one of its boundaries 38 as indicated in FIG. 4B. The line source 35*a*-35*d* in turn couples power (lines emanating from each respective line source and pointing downward) to the stubs in the parallel plate region (formed between the aperture and the feed plates 12 and 16) within each respective subarray 34*a*-34*n* to create an antenna pattern. Real time-averaged power flows away from the line source 35*a*-35*d* in the 'feeding direction' as indicated in FIG. 4B.

Figure 5:
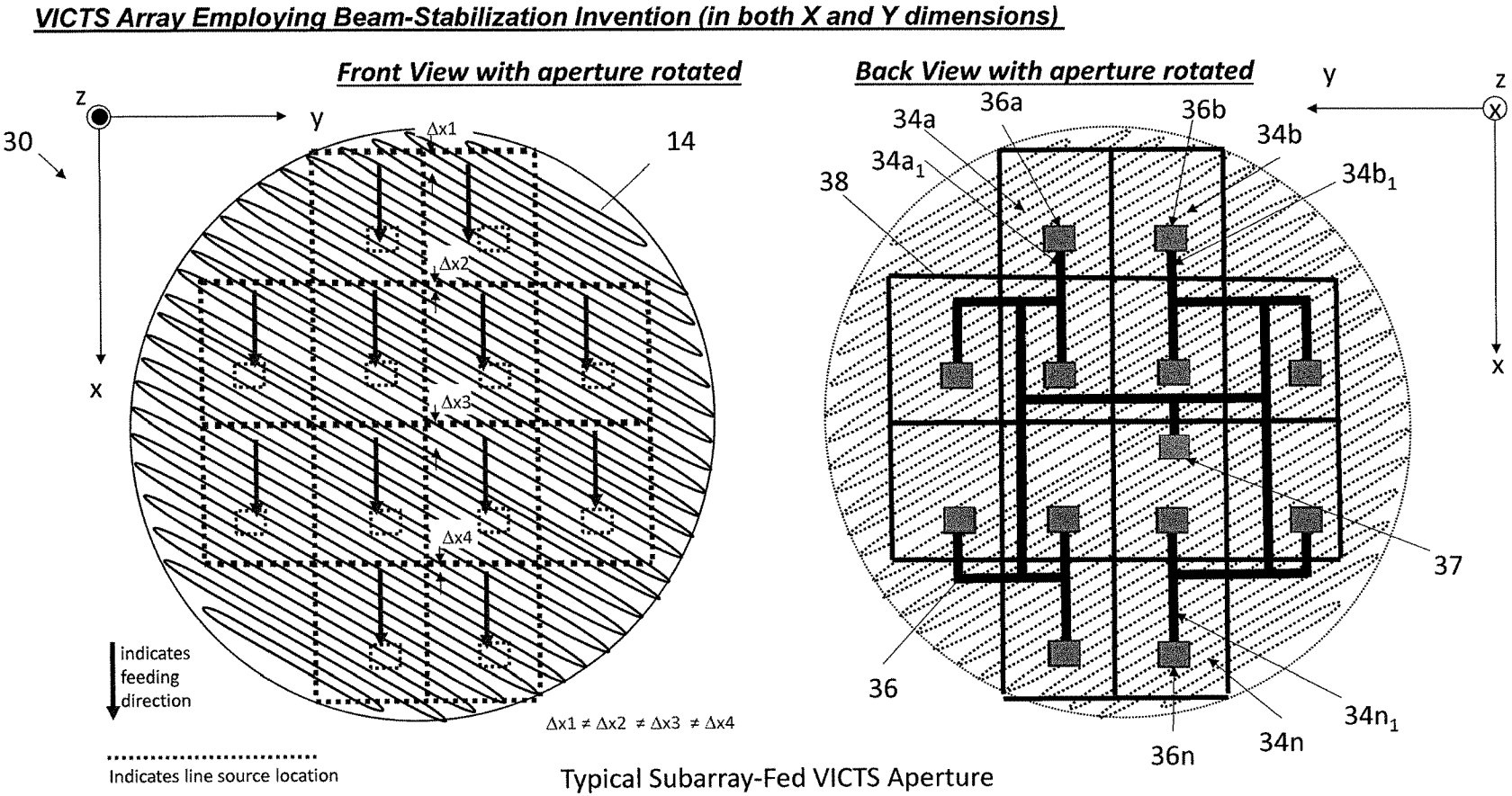
FIG. 5 is a schematic diagram showing a different physical and angular relationship between the aperture and subarray feeds (front and back views) for the VICTS antenna of FIG. 4A, in a typical scanned condition.

Within each subarray 34*a*-34*n*, at an aperture rotation angle of zero degrees, the distance between each subarray line source 35*a*-35*d* and a common point on a first slot/stub 14 in the 'feeding direction' as indicated in FIG. 4B is identical (i.e., equal phase). As the aperture rotation angle is increased above zero degrees, this distance increases linearly from subarray to subarray by an amount equal to the phase factor necessary to (phase) align all of the subarrays 34*a*-34*n* in two dimensions (x and y) at the design center frequency, as shown in FIG. 5. This action of creating linearly increasing phase factors between subarrays 34*a*-34*n* (as the aperture is rotated) is unique to subarrayed-fed VICTS antennas and allows the main beam of the full array to be steered to an arbitrary position in space without phase distribution errors and without the incorporation of additional phase-shifters at each subarray 34*a*-34*n* (as would otherwise be required in typical modularized Phased-Array embodiments.) In addition, in order to reduce frequency sensitivities, the corporate feed 36 is used to feed the subarrays 34*a*-34*n*.

Figure 6:
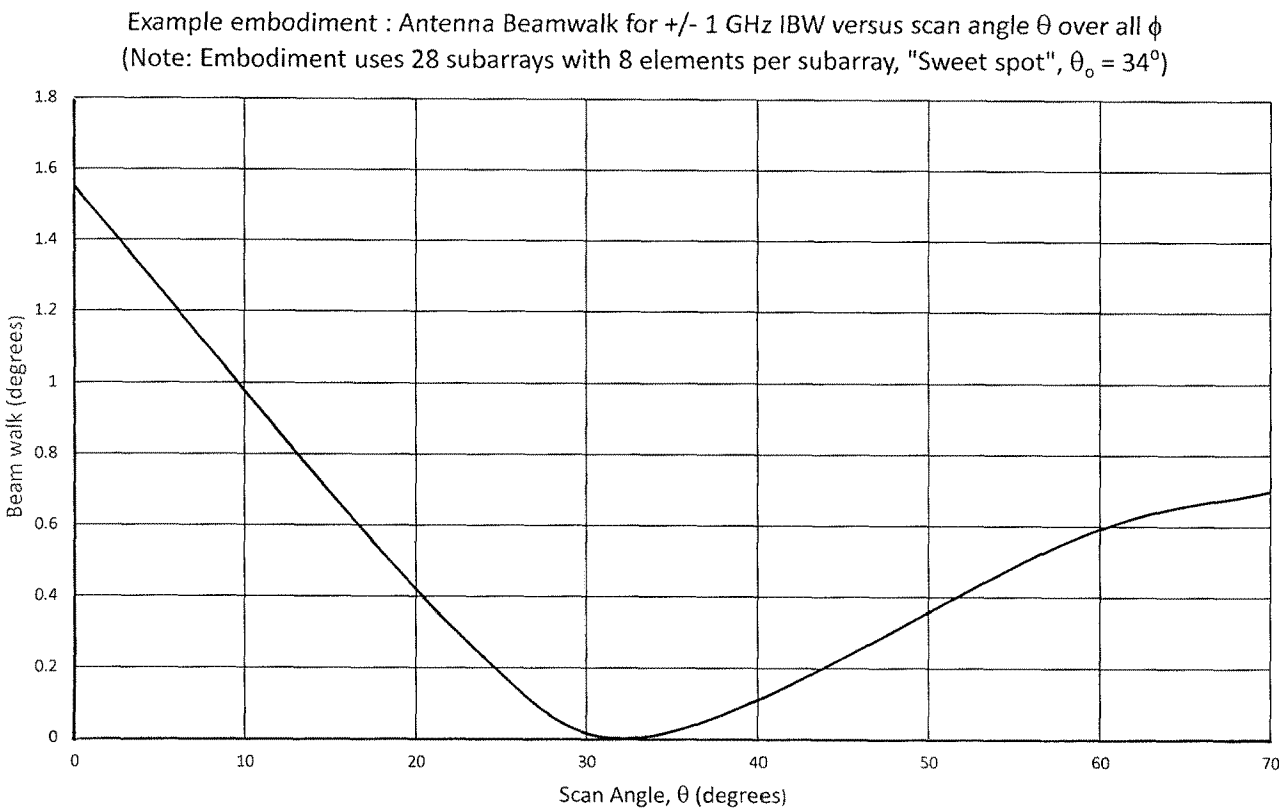
FIG. 6 is a graph illustrating beamwalk dependence relative to scan angle.

The corporate feed network 36 can be designed with two unique properties. First, the corporate feed network 36 can be configured to provide true-time delay feeding (minimum beamwalk) at some intermediate scan angle (typically 30 to 45 degrees—referred to as the "sweet spot") through proper physical line length selection of the individual arms of the feed (i.e., the line length between the input port 37 and an output port 36*a*-36*n* for the respective subarray 34*a*-34*n*). Second, the line lengths can be selected in such a manner that they supply a desired inter-subarray phasing over the rest of the scan volume needed to keep the main beam phase aligned at the design center frequency. In other words, the line lengths may be selected so that the subarrays 34*a*-34*n* all point in the same direction in a way that creates constructive interference, and phasing of each of the subarrays 34*a*-34*n* is such that they coherently combine in the direction of interest. This can be achieved by selecting the "sweet spot" so that the required line length difference between the input port 37 and each output port 36*a*-36*n* of the corporate feed 36 are multiples of 2 pi (360 electrical degrees.) Alternatively, integer multiples of Pi (180 electrical degrees) may be employed in conjunction with Pi (180 electrical degrees) phase-shifts realized via alternating feed geometries which provide a "natural" Pi (180 electrical degree) phase "flip." Examples of such alternating feed geometries include, but are not limited to, alternating offset waveguide slots (wherein a 180 electrical degree phase-shift is realized by offsetting the position of the slot to the opposite side of the waveguide broadwall centerline) or alternating "twist" waveguide transitions (wherein a 180 electrical degree phase-shift is realized by clockwise (CW) vs counter clockwise (CCW) rotation of the physical 90 degree waveguide twist.) A finer resolution in subarray-to-subarray line length difference (180 degree steps versus 360 degree steps) provides for increased design flexibility in achieving the desired beamwalk stabilization and the precise "sweet spot" angle. The "sweet spot" will be elevation angle (scan angle) dependent only, with azimuth arbitrarily selected by proper mechanical rotation of the VICTS array 30 (i.e. there is no beamwalk dependence with azimuth position). Such property cannot be achieved with a traditional phased array since its feed is fixed and can therefore be optimized at most at one scan angle in azimuth (and elevation). FIG. 6 shows beamwalk for an exemplary antenna in accordance with the present disclosure over +/−1 GHz of instantaneous bandwidth (43.5 to 45.5 GHz) with the "sweet spot" designed for a scan angle of 34 degrees (Note: This beamwalk characteristic is independent of azimuth angle (phi)).

The combination of subarraying the feed region 33 and adjusting the corporate feed line lengths as described eliminates the need for both discrete phase shifters and VTTDs, thus creating a completely passive 2-D Phased Array with superior IBW, lower ohmic loss, and less size and weight than a traditional Phased Array.

While the embodiment shown in FIGS. 4 and 5 illustrate how optimum phasing can be achieved in two dimensions (x and y), other variations are possible. These include embodiments that provide phasing in only one dimension (e.g., either x or y) and embodiments that provide optimum phasing using a traveling-wave feed (continuous in one dimension) rather than "block subarraying" via a corporate feed.

Figure 7A:
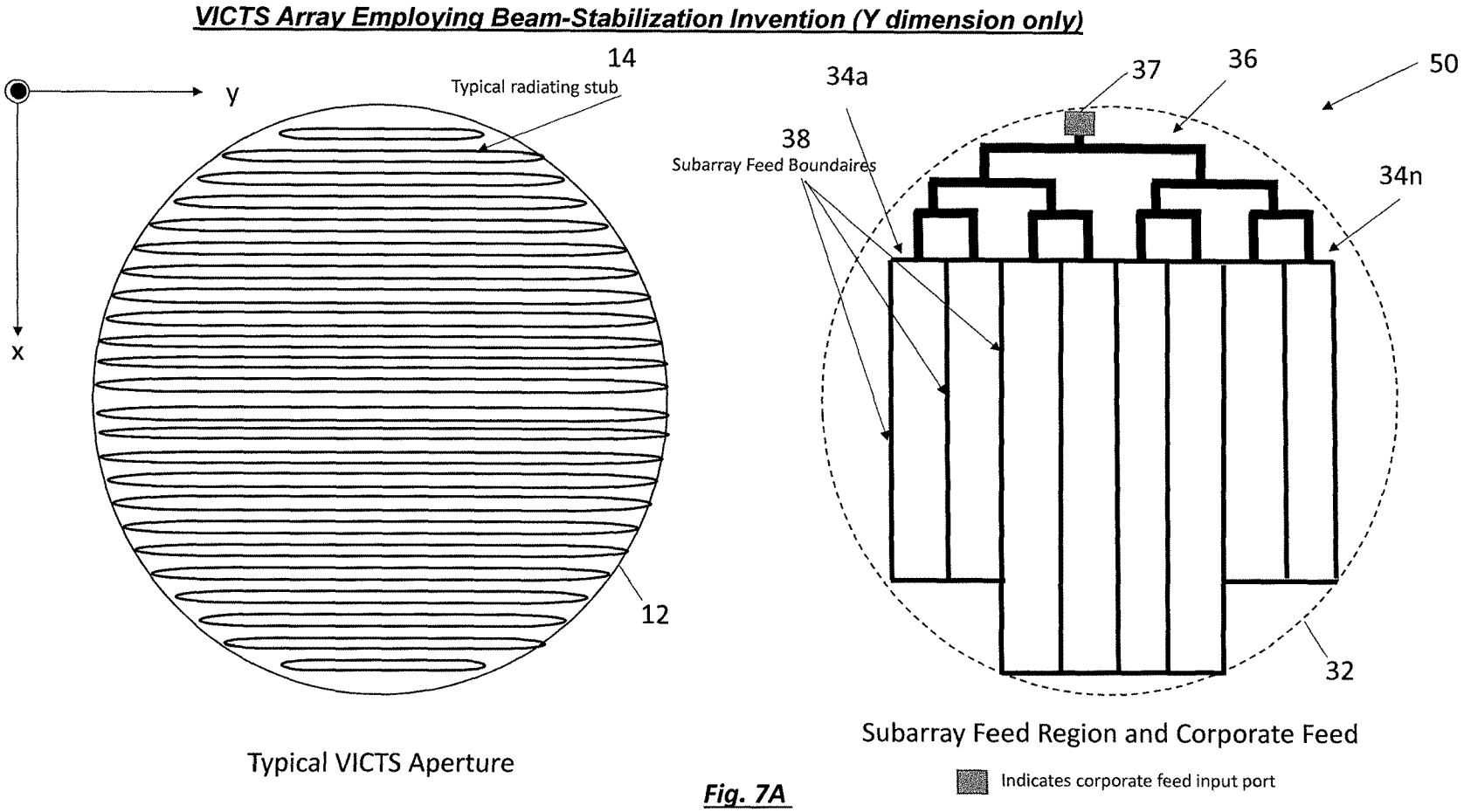
FIG. 7A is a schematic diagram showing an exemplary modularized VICTs aperture, subarray feed region and corporate feed for a VICTS antenna employing beam-stabilization in the Y dimension in accordance with the present disclosure.
Figure 7B:
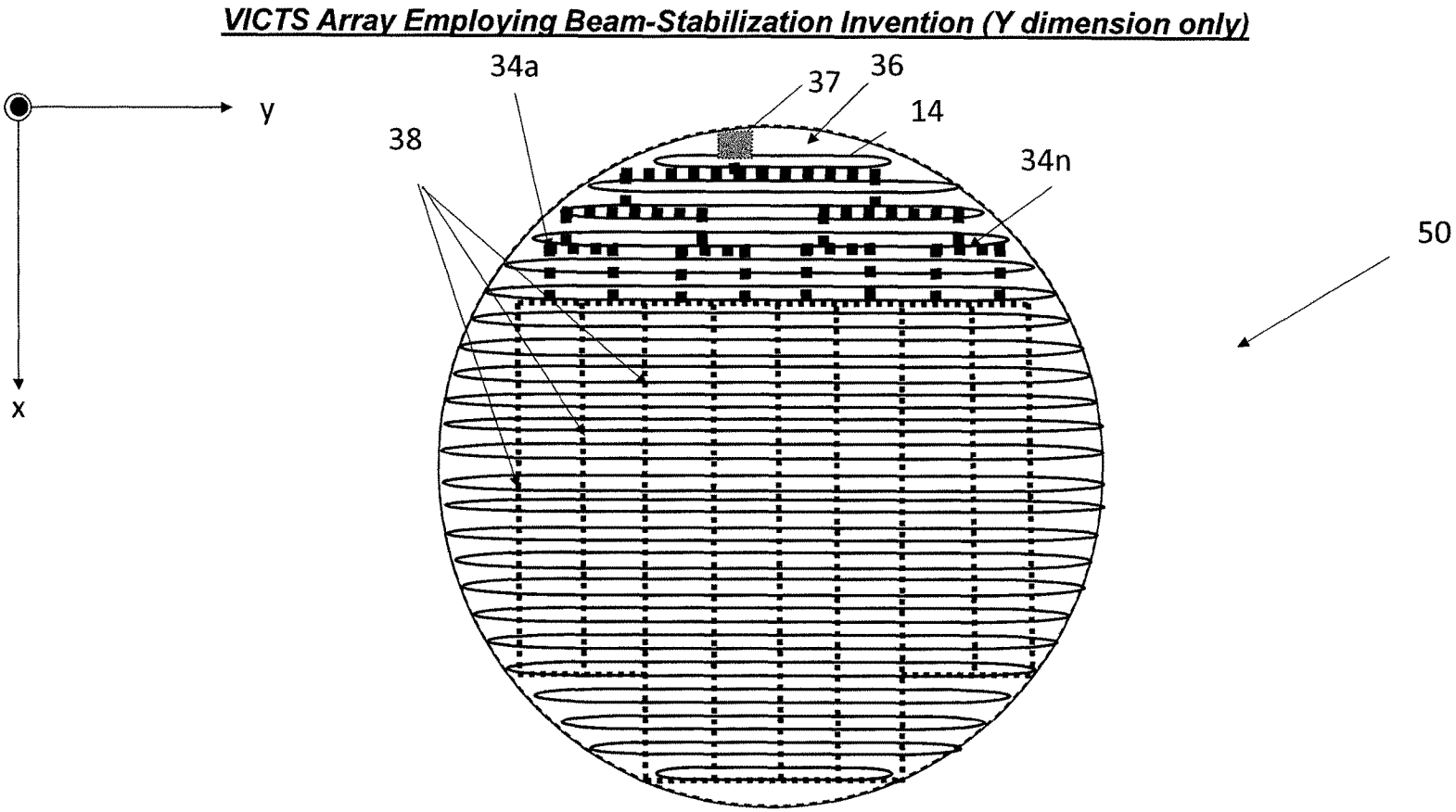
FIG. 7B is a schematic diagram illustrating the physical orientation of the integrated VICTS aperture with subarray feed region and corporate feed in the Y dimension in accordance with the present disclosure.
Figure 8A:
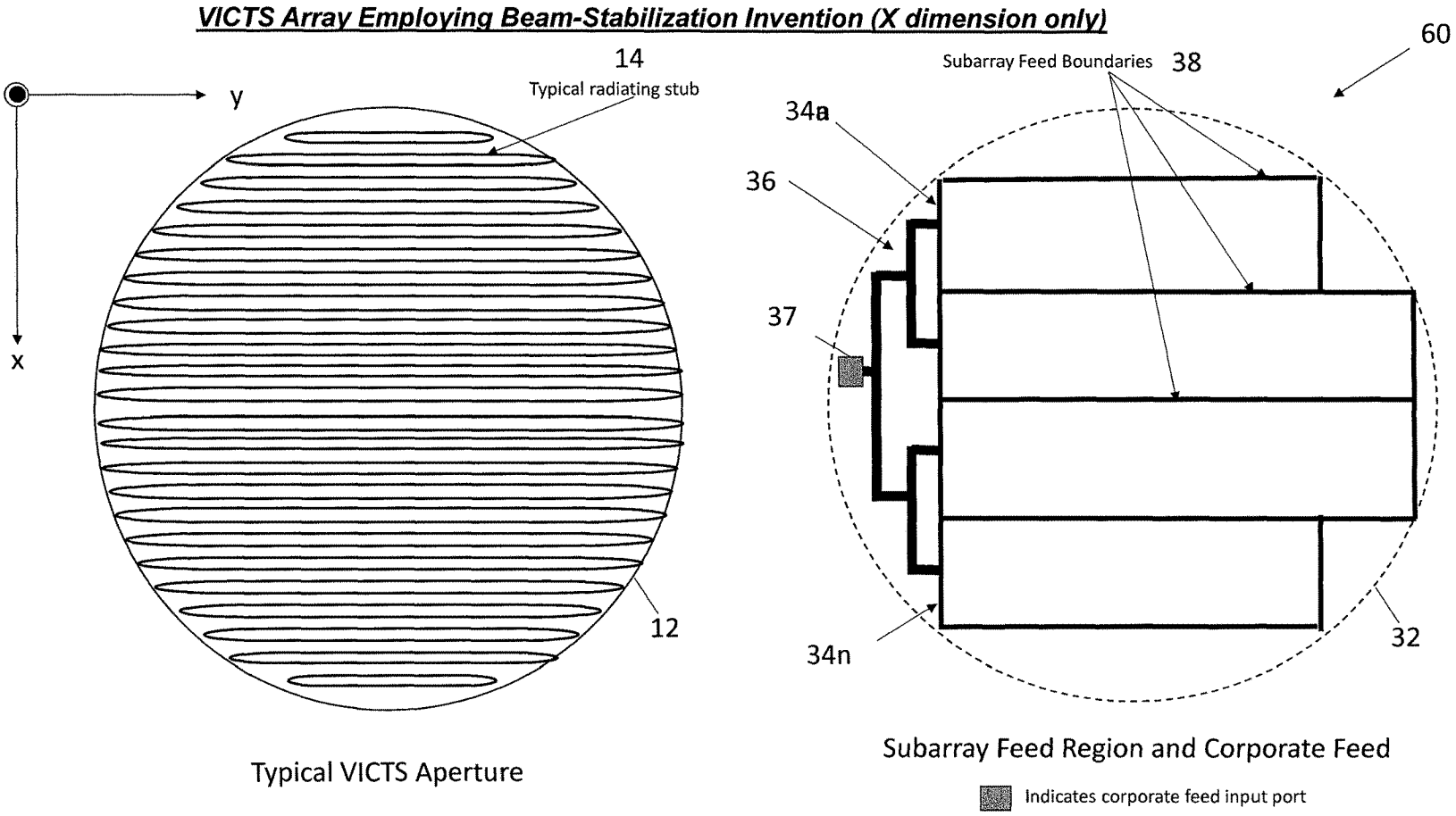
FIG. 8A is a schematic diagram showing an exemplary modularized VICTs aperture, subarray feed region and corporate feed for a VICTS antenna employing beam-stabilization in the X dimension in accordance with the present disclosure.
Figure 8B:
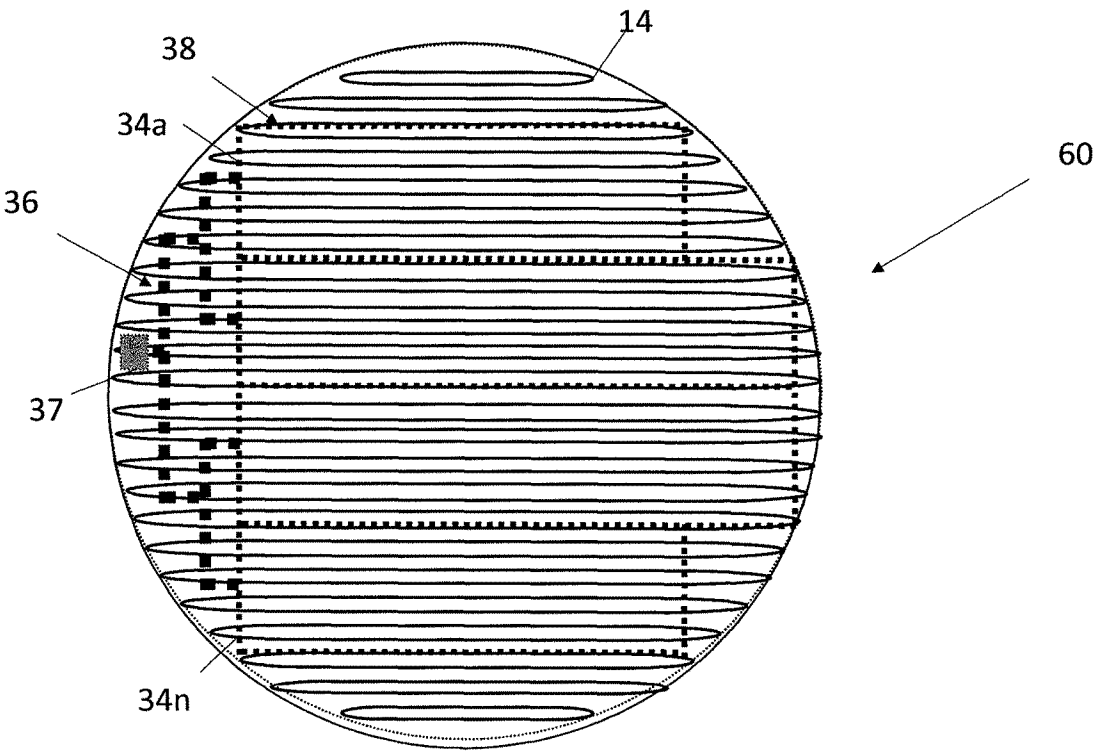
FIG. 8B is a schematic diagram illustrating the physical orientation of the integrated VICTS aperture with subarray feed region and corporate feed in the X dimension in accordance with the present disclosure.

FIGS. 7A and 7B show an embodiment 50 in accordance with the present disclosure that contains subarrays 34*a*-34*n* in the y-plane only. As shown in FIGS. 7A and 7B, the subarray feed boundaries 38 extend in the x plane. Individual line lengths from 37 to each subarray 34*a*-34*n* are different, progressively increasing in length from the left-most (34*a*) to the right-most (34*n*) locations. Here the line length differences of the feed 36 need only be phased for a "sweet spot" in a plane parallel to the y-plane. FIGS. 8A and 8B show an embodiment 60 that contains subarrays 34*a*-34*n* in the x-plane only, with the subarray feed boundaries extending in the y plane. Individual line lengths 37 to each subarray feed 34*a*-34*n* are different, progressively increasing in length from the top-most (34*a*) to the bottom-most (34*n*) locations. Here the line length differences of the feed need only be phased for a "sweet spot" in a plane parallel to the x-direction.

Figure 9A:
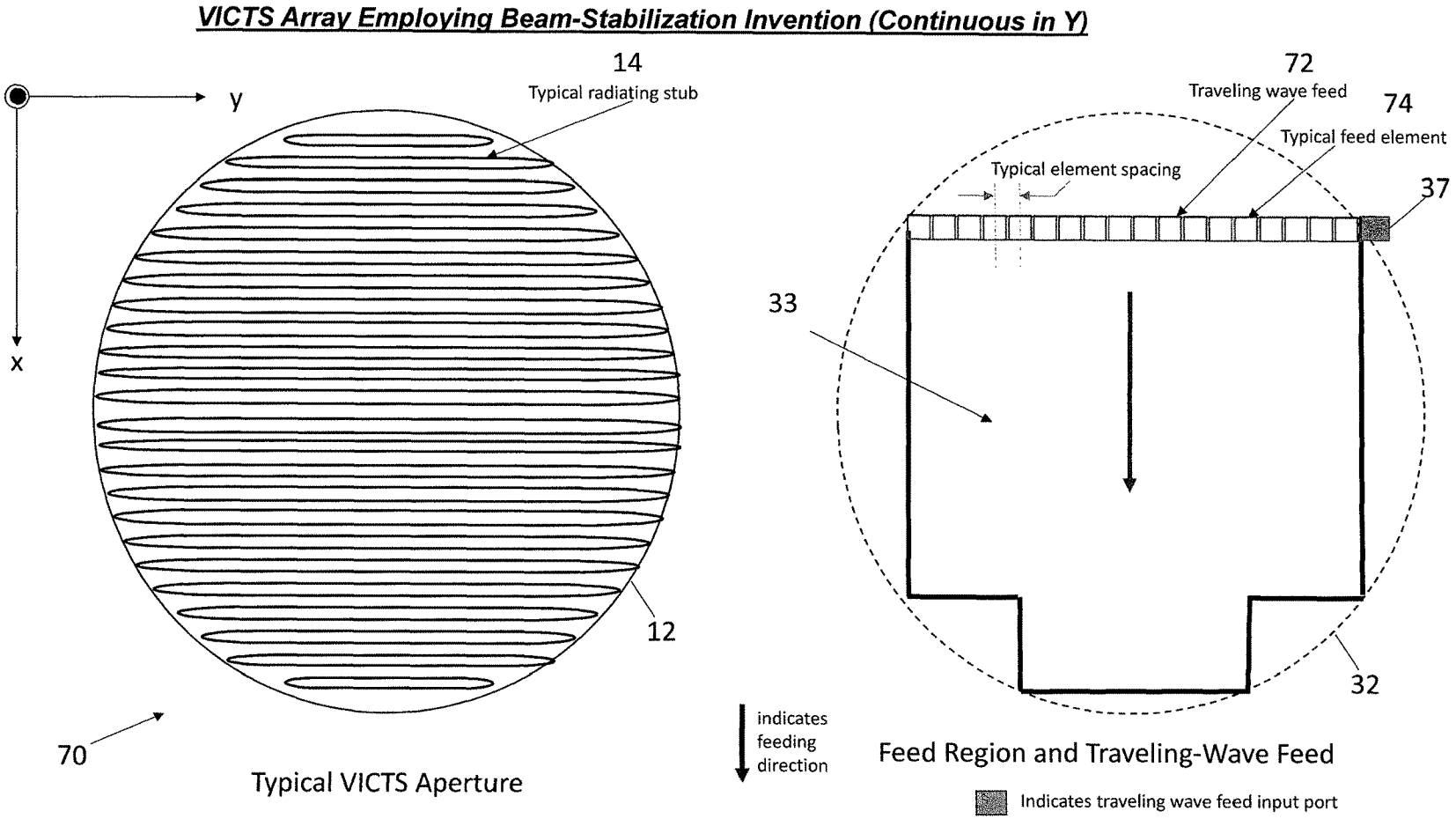
FIG. 9A is a schematic diagram showing an exemplary continuously-fed VICTs aperture, feed region and traveling-wave feed for a VICTS antenna employing beam-stabilization in the Y dimension in accordance with the present disclosure.
Figure 9B:
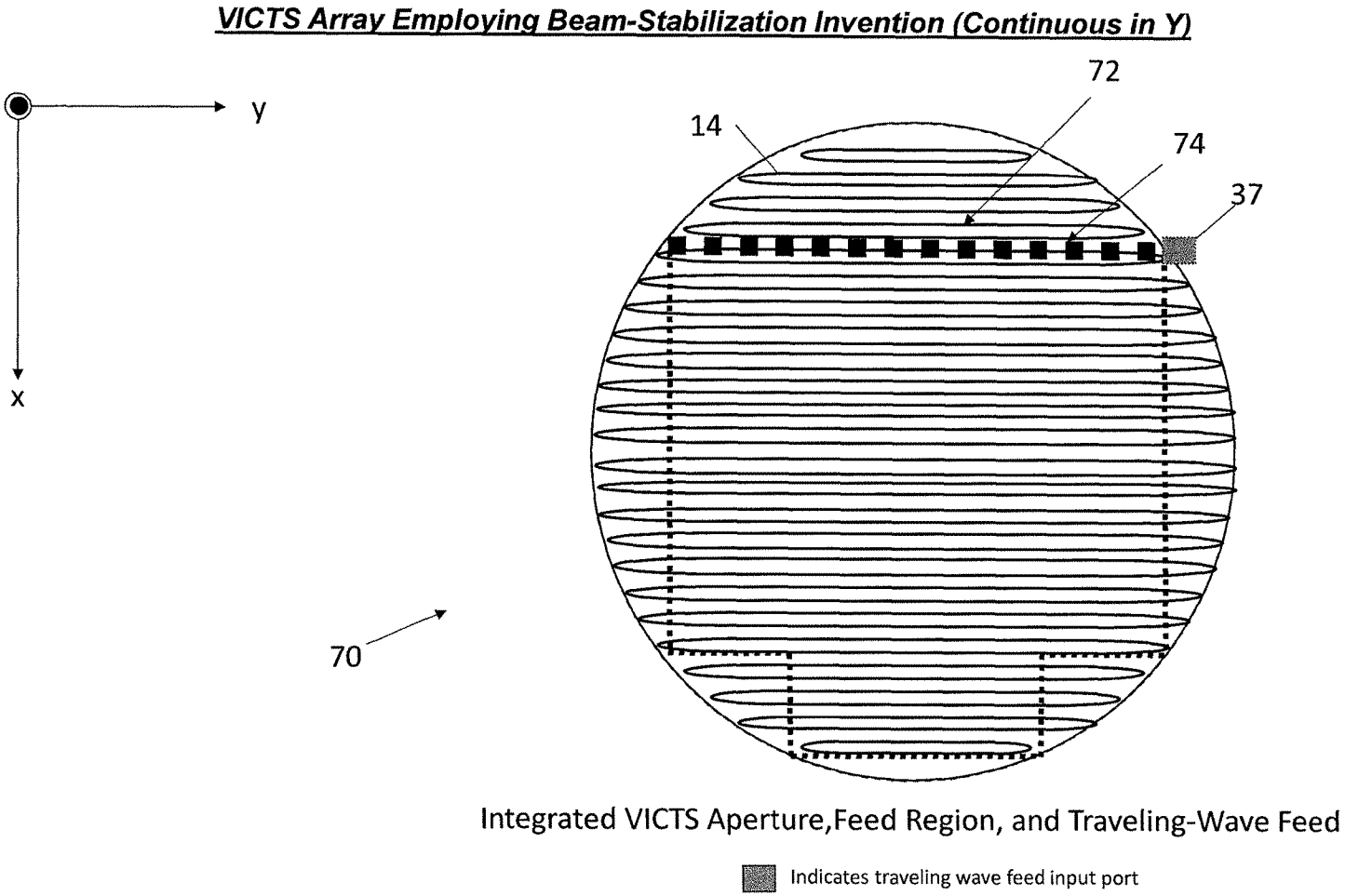
FIG. 9B is a schematic diagram illustrating the physical orientation of the integrated VICTS aperture, feed region and traveling wave in the Y dimension in accordance with the present disclosure.

FIGS. 9A and 9B show an embodiment of an antenna 70 in accordance with the present disclosure that does not contain subarrays in the x dimension. Instead, a traveling wave feed 72 is used to illuminate the full feed region 33 (the antenna is traveling wave fed in the y dimension). Each element 74 of the traveling wave feed 72 couples a small amount of power into the feed region 33. A spacing between each element 74, combined with the selected propagation constant and dispersion properties of the traveling wave feed 72 are selected in such a way that, over frequency, the composite phase of the coupled wave reduces the natural beam motion of the VICTS aperture versus frequency, thus increasing IBW.

Figure 10:
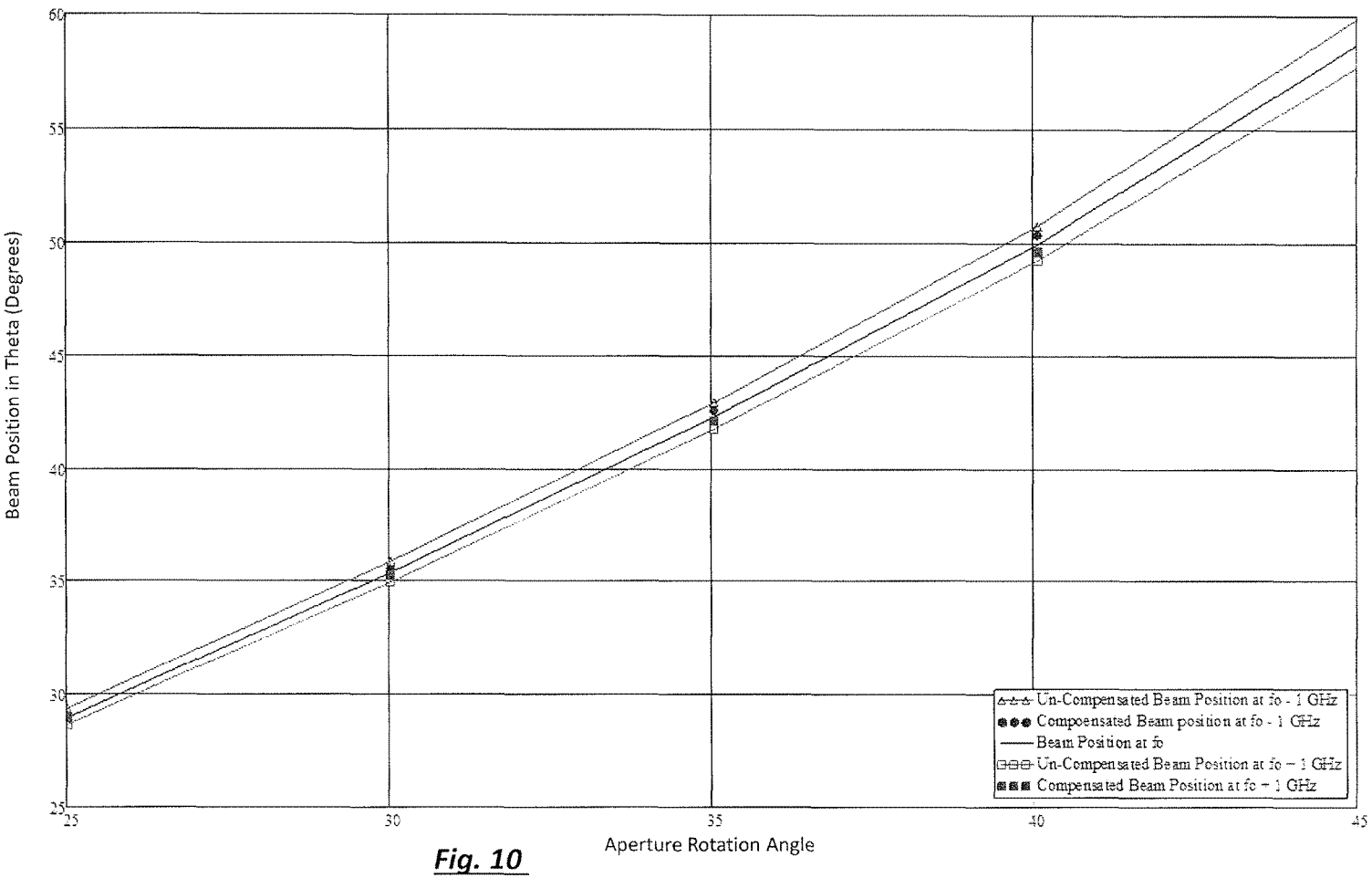
FIG. 10 is a graph showing beam position relative to aperture rotation angle.

FIG. 10 shows a comparison plot of uncompensated and (traveling wave fed) compensated scanned beam position (in theta) as a function of aperture rotation angle for a typical embodiment. One can observe that the beam position is stabilized (optimized) at a scan angle of 35 degrees (rotation angle of 30 degrees) favorably exhibiting reduced beamwalk (over +/−1 GHz IBW) for all angles.

Although the invention has been shown and described with respect to a certain embodiment or embodiments, equivalent alterations and modifications may occur to others skilled in the art upon the reading and understanding of this specification and the annexed drawings. In particular regard to the various functions performed by the above described elements (components, assemblies, devices, compositions, etc.), the terms (including a reference to a "means") used to describe such elements are intended to correspond, unless otherwise indicated, to any element which performs the specified function of the described element (i.e., that is functionally equivalent), even though not structurally equivalent to the disclosed structure which performs the function in the herein exemplary embodiment or embodiments of the invention. In addition, while a particular feature of the invention may have been described above with respect to only one or more of several embodiments, such feature may be combined with one or more other features of the other embodiments, as may be desired and advantageous for any given or particular application.

What is claimed is:

1. An antenna, comprising:

an aperture including a plurality of slots, the aperture defining a feed area of the antenna, the aperture divided into a plurality of discrete subarrays; and a feed network having an input port, a plurality of output ports, and a plurality of conductors, each conductor connected between the input port and a respective output port of the plurality of output ports, and each output port of the plurality of output ports connected to a respective subarray of the plurality of discrete subarrays, wherein a line length of one conductor of the plurality of conductors is different from a line length of another conductor of the plurality of conductors to introduce different time delays between the input port and the respective output ports, wherein for each subarray, at an aperture rotation angle of zero degrees, a distance between each subarray line source and a common point on a first slot of the plurality of slots in a feeding direction is identical, and as the aperture rotation angle is increased above zero degrees, a distance between each subarray line source increases linearly from subarray to subarray by an amount equal to a phase factor that aligns each of the subarrays in two dimensions at a design center frequency.

2. The antenna according to claim 1, wherein the line length between the input port and the respective output ports is configured to supply a prescribed inter-subarray phasing over a scan volume that maintains phase alignment of a main beam at a prescribed center frequency.

3. The antenna according to claim 1, wherein the line length between the input port and the respective output ports is configured to cause the plurality of subarrays to point in a direction that creates constructive interference.

4. The antenna according to claim 3, wherein the line length between the input port and the respective output ports is configured to cause the plurality of subarrays to coherently combine a signal in a prescribed direction.

5. The antenna according to claim 1, wherein a difference in line length between the input port and the respective output ports is a multiple of 2pi.

6. The antenna according to claim 1, further comprising alternating feed geometries that provide a phase shift of pi, wherein a difference in line length between the input port and the respective output ports is a multiple of pi.

7. The antenna according to claim 1, wherein individual line lengths between the input port and a respective output port progressively increase in length.

8. The antenna according to claim 1, wherein the plurality of subarrays and the feed network are passive devices.

9. The antenna according to claim 1, wherein the plurality of subarrays and the feed network form a passive two-dimensional phased array.

10. The antenna according to claim 1, wherein the plurality of subarrays and the feed network form a passive one-dimensional phased array.

11. The antenna according to claim 10, wherein the plurality of subarrays are arranged in a first plane of the antenna, and feed boundaries of the plurality of subarrays extend in a second plane of the antenna different from the first plane.

12. The antenna according to claim 11, wherein the feed network feeds the subarrays in the first plane, and a traveling wave feeds the subarray feed boundaries.

13. The antenna according to claim 12, wherein a spacing between each element of the traveling wave feed is configured to produce a composite phase of the coupled wave that reduces a natural beam motion of the antenna aperture versus frequency.

14. The antenna according to claim 11, wherein the first plane comprises one of the x-plane or the y-plane, and the second plane comprises the other of the x-plane or the y-plane.

15. The antenna according to claim 11, wherein the first plane comprises the x-plane, and differences in line length between the input port and the respective output ports are phased in a plane parallel to the x-plane.

16. The antenna according to claim 11, wherein the first plane comprises the y-plane, and differences in line length between the input port and the respective output ports are phased in a plane parallel to the y-plane.

17. The antenna according to claim 1, wherein the antenna does not include phase shifters or variable time delay devices.

18. The antenna according to claim 1, wherein the feed network is configured to provide true-time delay feeding at a prescribed intermediate scan angle.

19. The antenna according to claim 1, comprising an antenna input for receiving a radio frequency (RF) signal, the antenna input connected to the input port.

20. The antenna according to claim 1, wherein the antenna comprises a variable inclination continuous transverse stub (VICTS) antenna.

21. The antenna according to claim 20, wherein as an aperture of the antenna is rotated, linearly increasing phases factors are created between subarrays.

22. The antenna according to claim 20, comprising:

a first conductive plate structure including a first set of continuous transverse stub radiators arranged on a first surface; and a second conductive plate structure disposed in a spaced relationship relative to the first conductive plate structure, the second conductive plate structure having a surface parallel to the first surface; and a relative rotation apparatus operative to impart relative rotational movement between the first conductive plate structure and the second conductive plate structure.

23. The antenna according to claim 1, further comprising a polarizer.

24. The antenna according to claim 1, wherein a Normalized Beamwalk characteristic of the antenna comprises a specific non-uniform characteristic versus inclination angle such that maximum beamwalk occurs at 0 degree scan.

* * * * *